US008821200B2

(12) United States Patent
Krackhardt et al.

(10) Patent No.: US 8,821,200 B2
(45) Date of Patent: Sep. 2, 2014

(54) MODULAR GONDOLA DRIVE FOR A FLOATING DEVICE

(75) Inventors: Ernst-Christoph Krackhardt, Schenefeld (DE); Christian Norbert Mueller, Witzhave (DE); Jan Pellinghoff, Erlangen (DE); Dierk Schroeder, Selent (DE); Michael Wycisk, Moenkeberg (DE); Robin De Ruiter, Hamburg (DE)

(73) Assignee: Siemens Aktiengsellschaft, Munich (DE)

( * ) Notice: Subject to any disclaimer, the term of this patent is extended or adjusted under 35 U.S.C. 154(b) by 216 days.

(21) Appl. No.: 13/254,530

(22) PCT Filed: Feb. 26, 2010

(86) PCT No.: PCT/EP2010/052493

§ 371 (c)(1),
(2), (4) Date: Sep. 2, 2011

(87) PCT Pub. No.: WO2010/100092

PCT Pub. Date: Sep. 10, 2010

(65) Prior Publication Data

US 2011/0318978 A1 Dec. 29, 2011

(30) Foreign Application Priority Data

Mar. 2, 2009 (DE) ..... 10 2009 011 289
Sep. 30, 2009 (DE) ..... 10 2009 043 533

(51) Int. Cl.
*B63H 21/17* (2006.01)

(52) U.S. Cl.
USPC ..... 440/6; 440/75

(58) Field of Classification Search
USPC ..... 440/6, 75
See application file for complete search history.

(56) References Cited

U.S. PATENT DOCUMENTS 3,298,349 A 1/1967 Pledger et al.
3,593,050 A * 7/1971 Ware ..... 440/6

(Continued)

FOREIGN PATENT DOCUMENTS

DE 1 100 493 2/1961
DE 1100493 B 2/1961

(Continued)

OTHER PUBLICATIONS

German Patent and Trademark Office, Office Action Dated Sep. 1, 2010.

(Continued)

*Primary Examiner* — Lars A Olson
(74) *Attorney, Agent, or Firm* — Laurence A. Greenberg; Werner H. Stemer; Ralph E. Locher

(57) ABSTRACT

A gondola drive for a floating device has an underwater housing circulated around by water. The gondola drive contains a drive module which has a drive module housing and a shaft disposed therein, a transmission module with a transmission module housing and a transmission disposed therein and a propeller. The drive module and the transmission module are each configured as separate components connected to one another such that the drive module housing and the transmission module housing form at least a part of the underwater housing and that the shaft is coupled to the transmission for driving the propeller.

14 Claims, 6 Drawing Sheets

(56) References Cited

U.S. PATENT DOCUMENTS

| | | | | |
|---|---|---|---|---|
| 4,092,946 | A | 6/1978 | Kappas | |
| 4,099,478 | A | 7/1978 | Alexander, Jr. | |
| 4,311,470 | A | 1/1982 | Blanchard | |
| 5,009,621 | A | 4/1991 | Bankstahl et al. | |
| 6,921,303 | B2 | 7/2005 | Varis | |
| 7,452,251 | B2 * | 11/2008 | Boebel | 440/6 |
| 8,198,773 | B2 * | 6/2012 | Wishart | 440/6 |
| 2004/0014380 | A1 | 1/2004 | Varis et al. | |
| 2004/0248479 | A1 | 12/2004 | Hein et al. | |
| 2008/0233814 | A1 | 9/2008 | Reuter | |

FOREIGN PATENT DOCUMENTS

| | | | |
|---|---|---|---|
| DE | 75 14 656 | U1 | 2/1979 |
| DE | 7514656 | U1 | 2/1979 |
| DE | 196 48 417 | A1 | 5/1998 |
| DE | 601 18 157 | T2 | 8/2006 |
| EP | 1 972 545 | A1 | 9/2008 |
| FR | 2 248 979 | | 5/1975 |
| FR | 2248976 | A1 | 5/1975 |
| WO | 00/27696 | A1 | 5/2000 |
| WO | 02/26558 | A1 | 4/2002 |
| WO | 02/057133 | A2 | 7/2002 |

OTHER PUBLICATIONS

International Search Report of PCT/EP2010/052493, Dated Mar. 28, 2011.

* cited by examiner

MODULAR GONDOLA DRIVE FOR A FLOATING DEVICE

BACKGROUND OF THE INVENTION

Field of the Invention

The invention relates to a pod drive for a floating device.

EP 1 972 545 A1 discloses a pod drive for a marine vessel having an underwater housing around which water flows and which is arranged at the bottom on a hull of a marine vessel, having a propeller which is arranged outside the housing, and having a propeller shaft on which the propeller is seated. The propeller shaft is borne in the underwater housing. A gearbox in the form of an epicyclic gearbox is arranged in the housing and is coupled to the propeller shaft. The propeller shaft and the propeller are driven via the gearbox by a drive motor device which, for example, comprises an electric motor. This electric motor may be arranged in the interior of the housing, or outside the housing in the marine-vessel hull. If arranged in the marine-vessel hull, the propeller shaft and the propeller are driven via a vertical shaft [which is passed into the housing] through a stub via which the underwater housing is attached to the marine-vessel hull such that it can rotate, and a crown gear/bevel gear transmission, which is arranged between the gearbox and the vertical shaft.

WO 00/27696 A1 discloses a redundant pod drive having contrarotating propellers for driving marine vessels or other maritime objects, which consists of two identical or similar drive modules which are arranged together "back-to-back" in a hydrodynamically streamlined underwater housing around which water flows, and contrarotate. In this case, each model comprises a propeller, a propeller shaft, an electric motor, two supporting bearings and a thrust bearing, or a combination thereof with the associated mountings.

Pod drives such as these are used as a propulsion drive for relatively large floating devices, for example marine vessels or off-shore platforms, and are frequently also referred to as pod drives or steerable propellers. They normally have a power of 0.5 to 10 MW.

BRIEF SUMMARY OF THE INVENTION

Against this background, the object of the present invention is to specify a pod drive for a floating device, for example for a marine vessel or an off-shore platform, which can be produced cost-effectively and in this case can be flexibly matched to different power requirements. A further aim is that the pod drive should be quickly repairable in the event of a defect.

A pod drive according to the invention comprises an underwater housing around which water flows, a drive module with a drive module housing and a shaft which is arranged therein and is preferably also borne therein, a gearbox module with a gearbox module housing and a gearbox arranged therein, as well as a propeller. The drive module and the gearbox module are in this case each in the form of separate units, which are connected to one another such that the drive module housing and the gearbox module housing form at least a part of the underwater housing, preferably the entire underwater housing, and such that the shaft is coupled to the gearbox in order to drive the propeller.

The pod module therefore consists of separate, preferably standardized, modules, which can each be manufactured in their own right and tested for functionality at different production locations, and then be assembled at yet another location, for example on site in a ship yard, to form a pod drive.

One essential feature in this case is that the modules also each already comprise at least a part of the underwater housing of the pod drive. This allows the pod drive to be assembled particularly simply and cost-effectively. The drive module and the gearbox module may in this case form basic components of a modular building-block system for a pod drive, in which one or two drive modules, each having one or two gearbox modules can be assembled in a combined form to form a pod drive depending on the power requirements and further characteristic requirements for the pod drive (for example relating to efficiency, hydrodynamic characteristics).

In this case, the rotation speed of the shaft and of a motor which drives the shaft can be matched to a desired rotation speed of the propeller in a simple manner via the gearbox. A building-block system such as this offers particularly good capabilities for standardization, and therefore particularly cost-effective production of pod drives. In the event of a defect, only the relevant module need be replaced. The pod drive can therefore be repaired quickly and easily.

In one particularly simple configuration, the pod drive may in this case comprise one and only one drive module and one and only one gearbox module. In addition, the pod drive may in this case also comprise a hydrodynamically shaped terminating element which, together with the drive module housing and the gearbox module housing, forms the entire underwater housing.

In a further configuration, the pod drive may comprise a further gearbox module with a gearbox module housing and a gearbox arranged therein, as well as a further propeller, with the further gearbox module likewise being in the form of a separate unit. The drive module and the two gearbox modules are in this case connected to one another such that the drive module housing and the gearbox module housing form the underwater housing, and such that the shaft is also coupled to the gearbox of the further gearbox module in order to drive the further propeller.

The pod drive therefore consists of a drive module and two gearbox modules. The drive module in this case drives one propeller in each case, via a respective gearbox module. This allows the pod drive to be designed with two, preferably contrarotating, propellers, in which the swirl produced by the propeller which is arranged first in the flow direction is made use of, thus improving the efficiency of the pod drive.

In one alternative further configuration, the pod drive may comprise a further drive module with a drive module housing and a shaft arranged therein, a further gearbox module with a gearbox module housing, and a gearbox arranged therein, as well as a further propeller. The further drive module and the further gearbox module are likewise each in the form of separate units. The two drive modules are connected to one another and the further drive module is connected to the further gearbox module, such that the drive module housing and the gearbox module housing form the underwater housing, and such that the shaft of the further drive module is coupled to the gearbox of the further gearbox module in order to drive the further propeller. A respective arrangement consisting of a drive module, a gearbox module and a propeller can in this case be arranged back-to-back with a further arrangement consisting of a drive module, a gearbox module and a propeller, with the modules forming the entire underwater housing. This also allows the pod drive to be designed to improve efficiency, with two, preferably contrarotating, propellers.

In one alternative further configuration, the pod drive may comprise a further shaft which is arranged in the drive module housing of the drive module, a further gearbox module with a gearbox module housing and a gearbox arranged therein, as well as a further propeller, with the further gearbox module likewise being in the form of a separate unit. The drive module and the two gearbox modules are in this case connected to one another such that the drive module housing and the gearbox module housing form the underwater housing, and such that the further shaft is coupled to the gearbox of the further gearbox module in order to drive the further propeller. This allows the pod drive to be designed to improve efficiency with two propellers which can be driven independently of one another, and preferably contrarotate.

Particularly simple assembly and disassembly of the pod drive as explained above are possible during production thereof or when individual modules are replaced by the shaft of the drive module being connected via a, preferably detachable, plug connection to the gearbox of the gearbox module.

The shaft or shafts which is or are arranged in the drive module is or are in this case preferably driven by an electric motor.

On the one hand, this electric motor can be arranged in the drive module housing. Furthermore, it is also possible for the electric motor to be arranged in a stub via which the underwater housing is connected such that it can rotate to the floating device, with the electric motor then driving the shaft via a direction-changing gearbox, which is arranged in the drive module housing. However, it is also possible for the electric motor to be arranged in the interior of the floating device, and to drive the shaft via a vertical shaft, which runs through the stub, and a direction-changing gearbox, which is arranged in the drive module housing. In this case, in principle, it is also possible for the shaft also to be driven directly by an internal combustion engine, which is arranged in the interior of the floating device, rather than by an electric motor.

According to one particularly advantageous refinement when the electric motor is arranged in the drive module housing, the gearbox module is also used to support the motor in the direction of the rotation axis of the shaft.

If the pod drive has a terminating element as explained above, this is also advantageously used to support the motor in the direction of the rotation axis of the shaft.

Furthermore, the drive module housing can also be used to support the motor in the rotation direction of the shaft.

According to one refinement of particularly simple design, the shaft is borne only in the electric motor in the drive module. Outside the electric motor, no additional bearings then need to be provided in the drive module.

When an electric motor is used for the drive, this preferably comprises a rotor, which is coupled to the shaft, a stator and a motor housing, in which the rotor and the stator are arranged. The electric motor therefore has its own housing, which is different from the underwater housing of the pod drive. Therefore, the electric motor forms an intrinsically autonomous unit, which can be manufactured and tested at a production location which is different from the production location of the drive module or of the stub, and can subsequently be installed in the drive module or in the stub at the production location of the drive module or of the stub. The production costs and the construction time for the pod drive can thus be reduced.

In this case, an encapsulated motor is preferably used, with water cooling and with a rated rotation speed which is greater than the rated rotation speed of the propeller. It is therefore possible to use conventional cost-effective standard electric motors in the pod drive, which are distinguished by high reliability and little maintenance effort.

According to one refinement of particularly simple design, the drive module housing is tubular.

Weight advantages and further cost advantages in this case result from the drive module housing and the gearbox module housing being composed of glass-fiber-reinforced plastic (GFRP) or carbon-fiber-reinforced plastic (CFRP).

The invention and further advantageous refinements of the invention according to the features of the dependent claims will be explained in more detail in the following text with reference to exemplary embodiments in the figures, in which:

DESCRIPTION OF THE INVENTION

Figure 1:
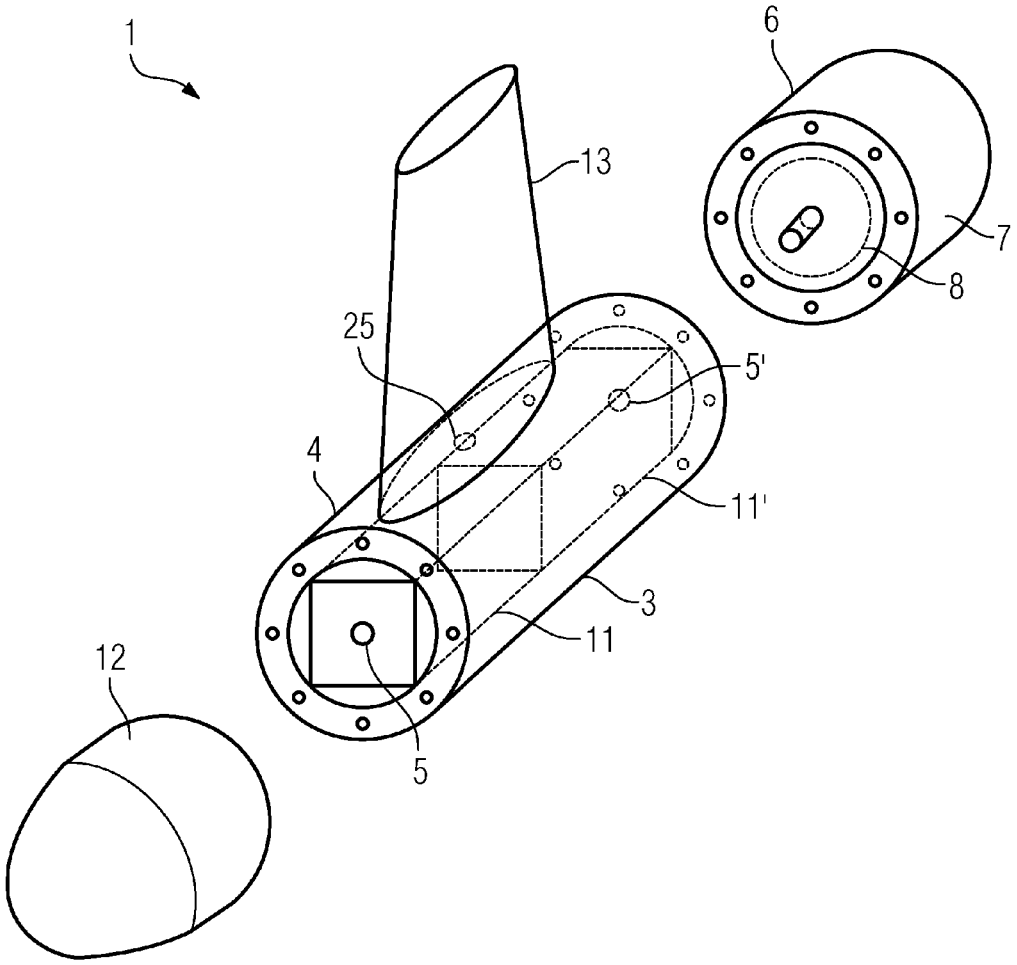
FIG. 1 shows the basic design of a pod drive according to the invention comprising a plurality of modules.

FIG. 1 shows the basic components of a building-block system, from which pod drives of different power and a different hydrodynamic characteristic can be produced cost-effectively for floating devices, such as marine vessels or off-shore platforms. The basic components comprise a drive module 3, a gearbox module 6, a hydrodynamically shaped terminating element in the form of a cover 12, and a stub 13. These components are each in the form of separate units, which can be combined with one another. As is shown in FIGS. 5-10, one or two drive modules 3 can in this case be combined with one or two gearbox modules 6. In this case, the torque can be produced by one or two electric motors 11, which are arranged either in a drive module 3, in the stub 13 or in the interior of the floating device.

The drive module 3 comprises a tubular drive module housing 4 and a shaft 5 which is arranged and borne therein. The drive module 3 may comprise an electric motor 11, which is arranged in the drive module housing 4, for driving the shaft 5, or alternatively a direction-changing gearbox, which is driven by a motor arranged in the stub 13 or in the interior of the floating device, in order to drive the shaft 5. Furthermore, the drive module 3 may also comprise a further shaft 5' borne therein and a further electric motor 11' in order to drive the further shaft 5'.

The stub 13 is attached to the tubular drive module housing 4. The drive module housing 4 has a bushing 25 for cables and tubes which are closed in a watertight manner with respect to the stub 13 (for example by means of a Brattberg seal). The gearbox module 6 comprises a gearbox housing 7 and a gearbox 8 arranged therein (for example an epicyclic gearbox).

Figure 2:
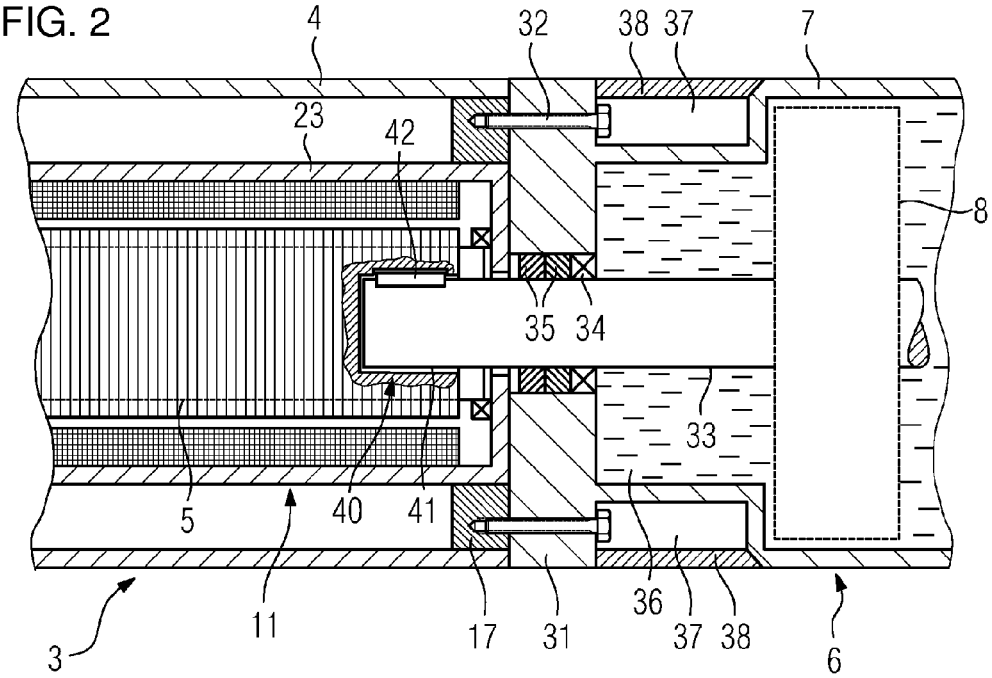
FIG. 2 shows a schematic partial view of a connection between a drive module and a gearbox module.

As illustrated in a schematic partial section in FIG. 2, the drive module housing 4 has a welded-in flange 17 at its end facing the gearbox module 6, and the gearbox module housing 7 has a flange 31 at its end facing the drive module 3. The gearbox module housing 7 may in this case be in the form of a cast housing, or may consist of a plurality of tubular sections which have been welded together. A gearbox shaft 33 is borne in the flange 31 by means of bearings 34. Seals 35 are used to seal the bearing 34 with respect to an outlet of gearbox liquid 36.

The connection between a drive module 3 and a gearbox module 6 is then made on the one hand by attachment of the flange 31 of the gearbox module housing 7 to the flange 17 of the drive module housing 4 by means of screws 32. The flange 31 of the gearbox module housing 7 is in this case also at the same time used to support the motor 11 in the direction of the rotation axis of the shafts 5, 33. A depression 37, which is formed in the gearbox module housing 7, for insertion and attachment of the screws 32 can be closed in a watertight manner by a suitable cover 38 after assembly.

On the other hand, the connection between a drive module 3 and a gearbox module 6 is provided by coupling the shaft 5 of the motor 11 to the shaft 33 of the gearbox 8. For this purpose, the two shafts 5, 33 can be detachably connected to one another via a plug connection 40. For this purpose, the motor shaft 5 has an opening in the form of a sleeve 41, into which the gearbox shaft 33 can be inserted. An adjusting spring 42 is used for interlocking, and therefore rotationally fixed, connection in the rotation direction of the shafts 5, 33. Alternatively, an interlocking connection can also be made by profiles which are matched to one another on the outside of the gearbox shaft 33 and on the inside of the sleeve 41 (for example in the form of a polygonal profile).

In principle, the opening in the form of a sleeve or some other shape which is suitable for transmission of torques can also be located in the gearbox 8 (for example in the gearbox shaft 33), in which case the shaft 5 can then be inserted into the gearbox opening.

Figure 3:
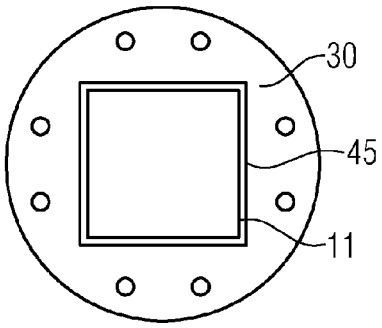
FIG. 3 shows one preferred refinement for a connecting flange of the drive module housing.

As is shown in FIG. 3, the flange 17 on the drive module housing 4 advantageously has an internal profile 45 which is matched to the external profile of the motor 11 such that the flange 17 supports the motor 11 in the rotation direction of the motor shaft 5.

The shaft 5 is borne in the drive module 3 by means of the bearings 26, which are only in the electric motor 11. No further bearing is provided for the shaft 5 in the drive module 3 outside the electric motor 11.

Figure 4:
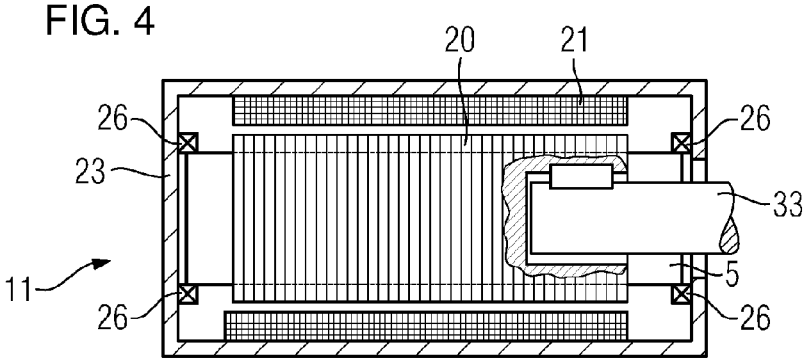
FIG. 4 shows the design of an electric motor from FIGS. 1 and 2.

As is illustrated in a simplified form in FIG. 4, the electric motor 11 is an intrinsically encapsulated standard electric motor with water cooling and with a rated rotation speed which is greater than the rated rotation speed of the propeller 9. The electric motor 11 comprises a rotor 20, which is coupled to the shaft 5, a stator 21 and its own motor housing 23, in which the rotor 20 and the stator 21 are arranged. The shaft 5 is borne in the electric motor 11 via bearings 26 which are arranged in the interior of the motor housing 23. In order to simplify the illustration, further components of the motor 11, such as seals, lines for a cooling water inlet and outlet, electrical connecting cables, etc., have been omitted. Particularly high efficiency and a small physical size in this case are possible by the electric motor 11 being in the form of an electric motor with permanent magnet excitation.

Figure 5:
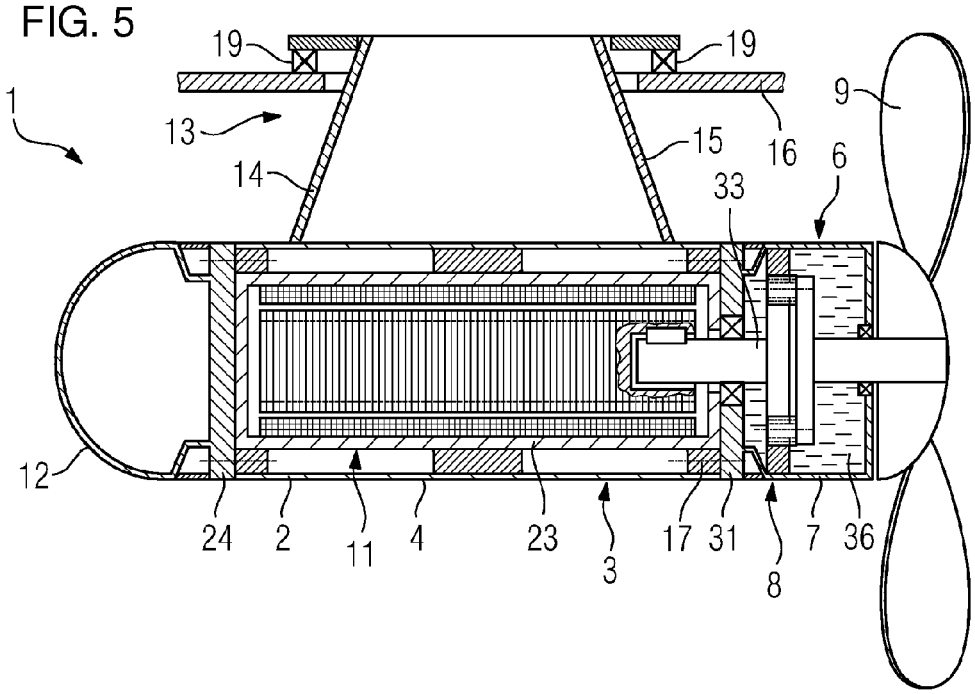
FIG. 5 shows a pod drive having a drive module with an electric motor and with a gearbox module.

According to one refinement, which is illustrated in FIG. 5, the pod drive 1 in each case comprises one and only one such drive module 4 and gearbox module 6 which are connected to one another—as described above—such that the drive module housing 4 and the gearbox module housing 7 form a part of the underwater housing, and the shaft 5 is coupled to the gearbox 8, in order to drive the propeller 9. Furthermore, the pod drive 2 comprises a terminating element in the form of a terminating cover 12. The gearbox module 6 is arranged at one end of the drive module 3, and the terminating cover 12 is arranged at the other end of the drive module 3. The connection between the drive module 3 and terminating cover 12 is made by means of a flange 24 on the terminating cover 12, which is attached by means of screws to a corresponding mating flange on the drive module housing 4.

The drive module housing 4, the gearbox housing 7 and the terminating cover 12 form the entire underwater housing 2, which is in the form of a pod and around which water flows, of the pod drive 1. The drive module housing 7 and the terminating cover 12 are in this case used to support the motor 11 in the direction of the rotation axis of the shaft 5. Alternatively, the terminating cover may also be part of the drive module. The drive module 3 comprises an electric motor 11 as shown in FIG. 3, which is arranged in the interior of the drive module housing 4 and drives the shaft 5.

The gearbox housing 7 is connected via the flange 17 to the drive module housing 4 and seals the drive module housing 4 on its end face in a watertight manner, thus resulting in a closed-off area, which is free of water, in the interior of the drive module housing 4. The flange 31 of the gearbox module housing 7 is at the same time also used to hold and support the motor 11. On its side opposite the output-drive side of the motor 11, the gearbox 8 has the capability for attachment of a propeller 9 (for example via a flange). The gearbox housing 7 is filled completely with oil 36. This is preferably an encapsulated gearbox, which is provided with seals on the motor side and water side. Since the seals are always lubricated with the oil, this results in a longer life. The gearbox 8 is preferably connected via a tubular connection to the floating device, via which the oil level and the oil temperature are set (by means of a heat exchanger and pump), and the oil quality is measured.

The gearbox 8 is preferably a multiple stage epicyclic gearbox. The gearbox can then be provided with different transmission ratios by suitable choice of planet wheels, sun wheel and hollow wheel, simply by replacing the gearwheels. The gearbox 8 preferably has a step-down ratio from 10:1 to 25:1.

The stub 13 is preferably assembled from two halves 14, 15. The two halves may be formed from metal sheets which are welded together and are then welded to the drive module housing 4. However, the two halves advantageously consist of GFRP or CFRP parts, which are first of all joined to one another integrally and are then joined to the drive module housing 4.

The pod drive 1 can be attached rotatably, via bearings 19, to a floating device 16, for example to the hull of a marine vessel or to an off-shore platform. In this case, electrical power can be transmitted to the electric motor 11 via slip-rings. In order to avoid complex slipring transmission, the rotation capability of the pod drive 1 can also be limited in both directions. For example a limit can be provided at 270° in each direction. The cables and tubes to be carried in the stub 13 can be correspondingly rolled up, thus allowing them to follow the rotation. By way of example, the high-speed standard electric motor provided with a worm drive can be used for rotation of the pod drive 1. This electric motor advantageously originates from the same type series as the electric motor 11 in the pod drive 1, but has a lower power.

The stub 13 may in this case be closed by a flange at its upper end. The stub 13 can be sealed at the top by this flange, thus allowing fitting from underneath, even without docking.

If the flange is flange-connected to a rotation apparatus for the pod drive 1, a smaller inner flange is opened, thus allowing access to cables and tubes or flexible tubes which are carried in the stub 13.

In this case, it is also possible for the pod drive 1 to be retractable and extendible into and out of the floating device 16.

The shaft 5 is borne in the drive module 3 via bearings, which are not illustrated in any more detail, in the electric motor 11, as shown in the illustrations in FIGS. 2 and 4. No bearing is provided for the shaft 5 in the drive module 3 outside the electric motor 11.

Figure 6:
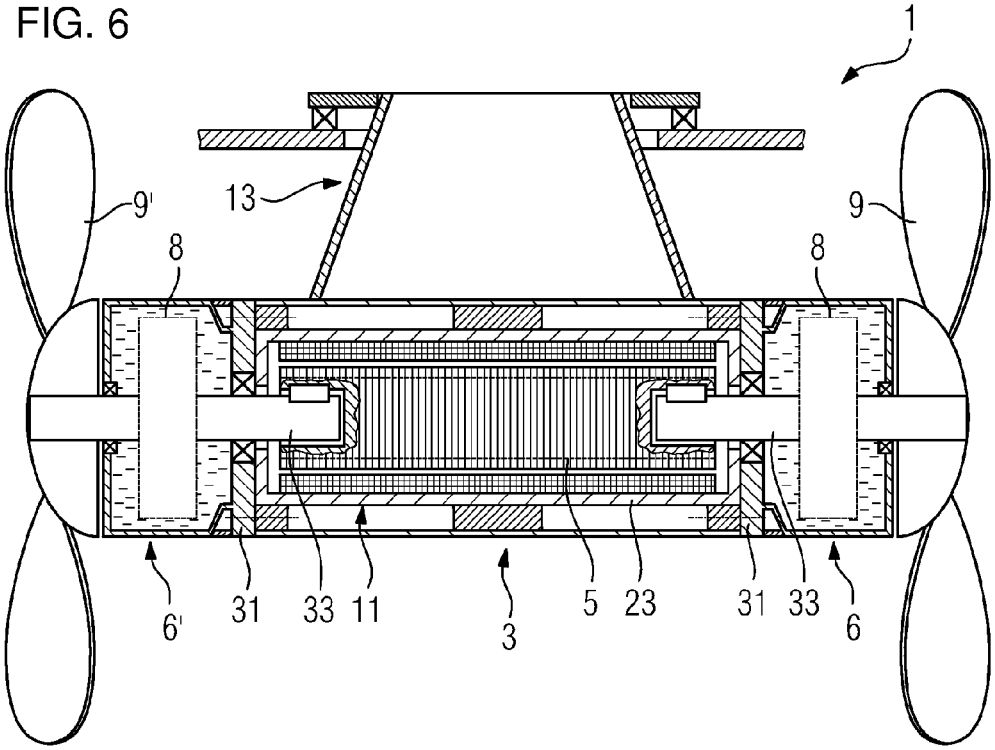
FIG. 6 shows a pod drive having a drive module with an electric motor and with two gearbox modules.

In contrast to the pod drive shown in FIG. 5, a pod drive 1 as shown in FIG. 6 comprises, instead of the terminating cover 12, a further gearbox module 6' with a gearbox module housing 7 and a gearbox 8 arranged therein, as well as a further propeller 9'. A gearbox module 6, 6' is therefore arranged at each of the two ends of the drive module 3. The drive module 3 and the two gearbox modules 6, 6' are connected to one another such that the drive module housing 4 and the gearbox module housing 7 form the entire underwater housing 2. In this case, the shaft 5 is coupled via a plug connection to the gearbox 8 in the further gearbox module 6', in order to drive the further propeller 9'. The electric motor 11 therefore drives both propellers 9, 9', preferably such that they contrarotate, via the shaft 5 and the gearbox 8. The shaft 5 is borne in the drive module 3 via bearings, which are not illustrated in any more detail, in the electric motor 11, as shown in the illustration in FIGS. 2 and 4.

Figure 7:
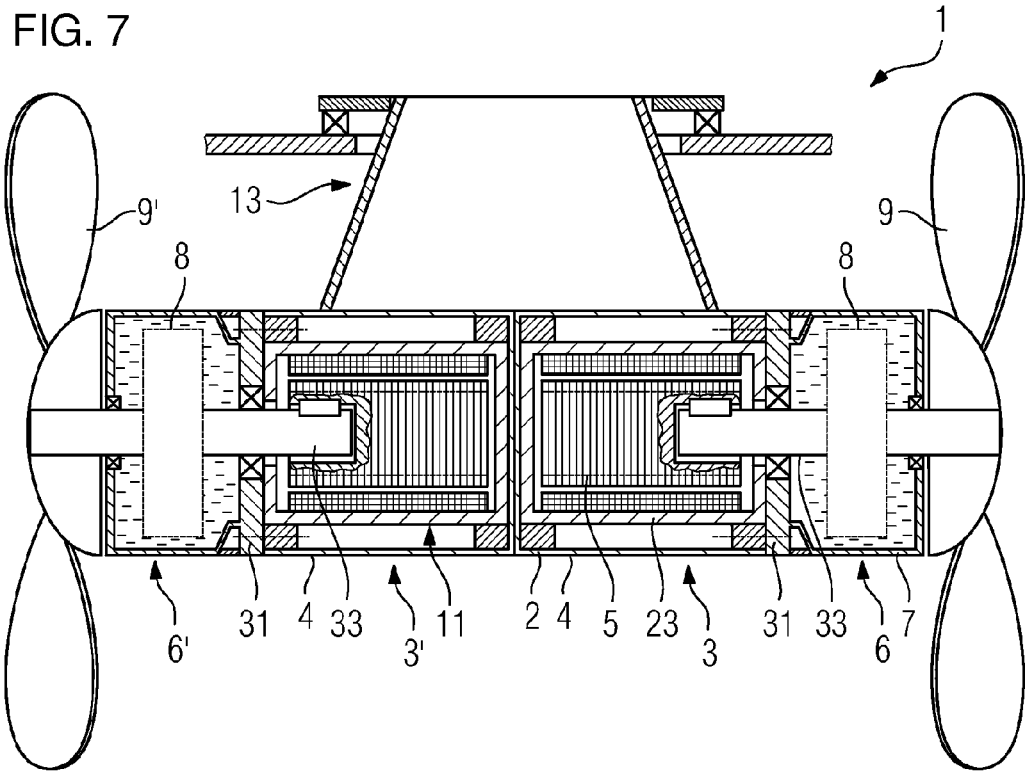
FIG. 7 shows a pod drive having two drive modules each having an electric motor and having two gearbox modules.

In contrast to the pod drive shown in FIG. 5, a pod drive 1 as shown in FIG. 7 comprises instead of terminating cover 12, a further drive module 3' with a drive module housing 4, and a shaft 5 arranged therein, a further gearbox module 6' with a gearbox module housing 7, and a gearbox 8 arranged therein, as well as a further propeller 9'. The two drive modules 3, 3' are arranged back-to-back, and a gearbox module 6, 6' is in each case arranged on their side facing away from the respective other drive module. The two drive modules 3, 3' are connected to one another, the drive module 3 is connected to the gearbox module 6 and the further drive module 3' is connected to the further gearbox module 6' in this case such that the drive module housings 4 and the gearbox module housings 7 form the underwater housing 2 and such that the shaft 5 for the drive module 3 is coupled via a plug connection to the gearbox 8 of the gearbox module 6 for driving the propeller 9, and the shaft 5 of the further drive module 3' is coupled via a plug connection to the gearbox 8 of the further gearbox module 6' in order to drive the further propeller 9'. Each of the drive modules 3, 3' in this case has an electric motor 11, which is arranged in the interior of its respective drive module housing, and in each case drives a propeller 9, 9' via the shaft 5 of the drive module 3, 3'. The shafts 5 are borne in the drive modules 3, 3' via bearings, which are not illustrated in any more detail, in the respective electric motor 11 of the drive module 3, 3', as shown in the illustration in FIGS. 2 and 4.

Figure 8:
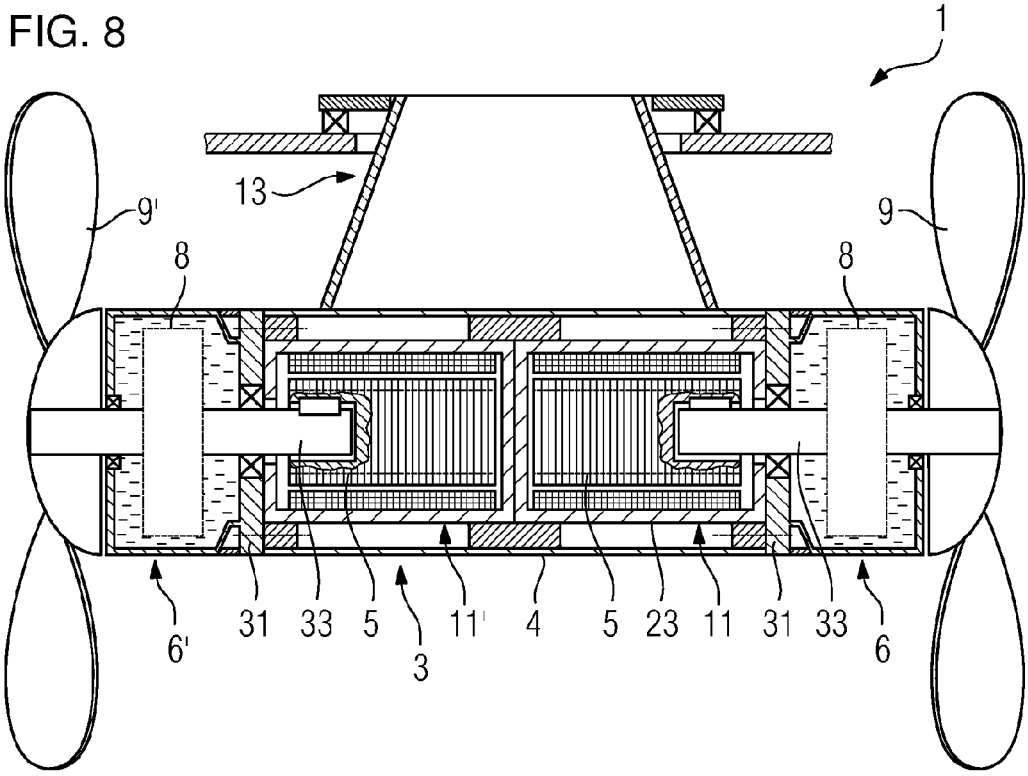
FIG. 8 shows a pod drive having a drive module with two electric motors and with two gearbox modules.

In contrast to the pod drive shown in FIG. 5, in the case of a pod drive 1 as shown in FIG. 8 the drive module 3 also comprises a further shaft 5' and a further electric motor 11 in order to drive the shaft 5', which are additionally also arranged in the drive module housing 4 of the drive module 3. Instead of the terminating cover 12, the pod drive 1 comprises a further gearbox module 6' having a gearbox module housing 7 and a gearbox 8 arranged therein, as well as a further propeller 9'. The two motors 11, 11' are arranged back-to-back in the drive module housing 4, such that they support one another. The drive module 3 and the two gearbox modules 6, 6' are in this case connected to one another such that the drive module housing 4 and the gearbox module housing 7 form the underwater housing 2, and such that the further shaft 5', driven by the further electric motor 11', is coupled via a plug connection to the gearbox 8 of the further gearbox module 6', and thus drives the further propeller 9'. The two propellers 9, 9' can therefore be driven independently of one another, in particular contrarotating, by means of the two electric motors 11, 11'. The shafts 5 are borne in the drive module 3 via bearings, which are not illustrated in any more detail, in the respective electric motor 11 of the drive module 3, as shown in the illustration in FIGS. 2 and 4.

Figure 9:
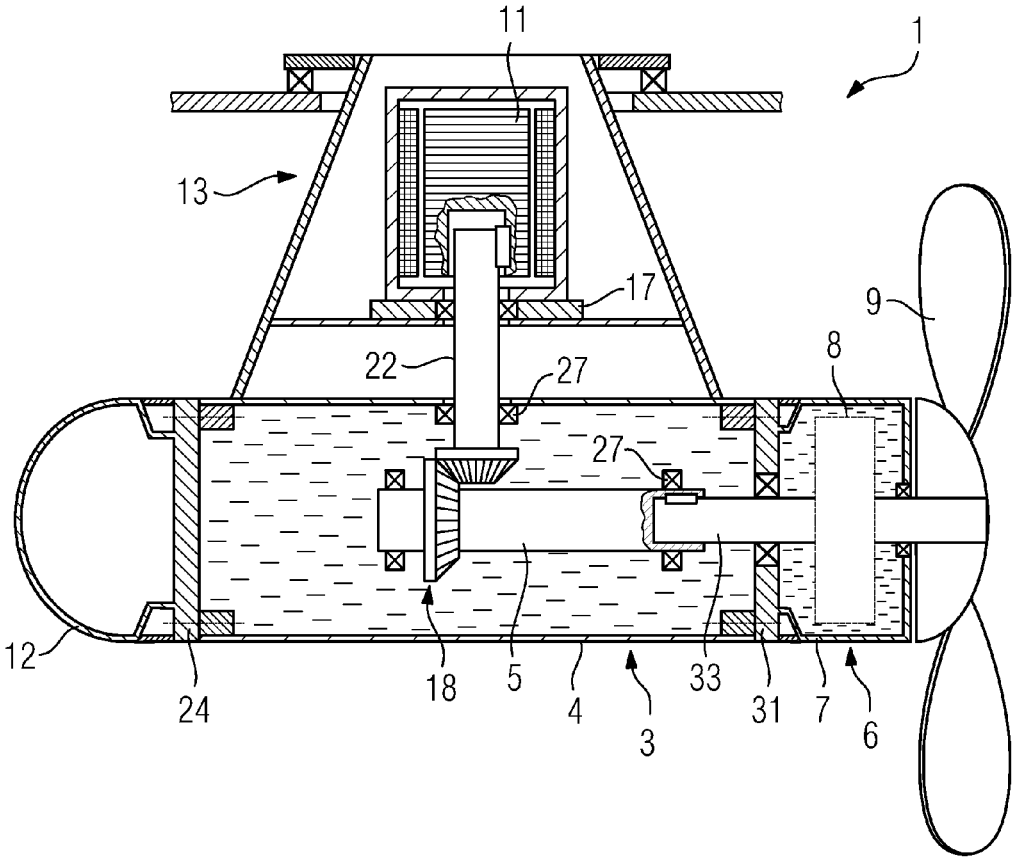
FIG. 9 shows a pod drive having a drive module, a gearbox module and an electric motor arranged in a stub.

In contrast to the pod drive shown in FIG. 5, in the case of a pod drive 1 as shown in FIG. 9, the electric motor 11 is arranged in the stub 13, and a direction-changing gearbox 18 is arranged in the drive module housing 4, instead of the electric motor 11. In this case, the electric motor 11 is mounted in the stub 13 via a stub 17. The direction-changing gearbox 18 is connected on the one hand to the shaft 5 and on the other hand to an output-drive shaft 22 of the electric motor 11. The electric motor 11 therefore drives the propeller 9 via the output-drive shaft 22, the direction-changing gearbox 18, the shaft 5 and the gearbox 8. The shaft 5 and the direction-changing gearbox 18 are borne in the drive module housing 4 via bearings 27. In this case, the shaft 5 is connected to the gearbox shaft 33 such that they rotate together, and the output-drive shaft 22 is connected to the direction-changing gearbox 18 such that they rotate together, via a respective plug connection.

Figure 10:
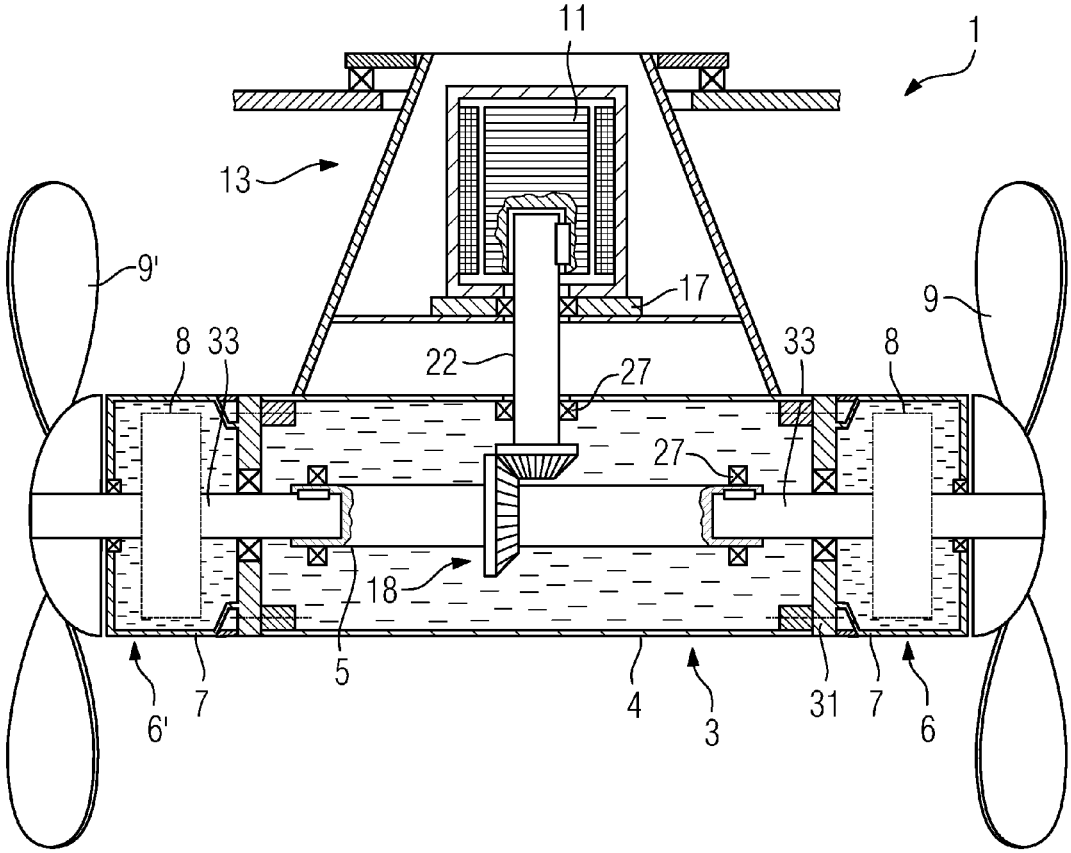
FIG. 10 shows a pod drive having a drive module, two gearbox modules and an electric motor arranged in a stub.

A pod drive 1 as shown in FIG. 10 corresponds to the pod drive shown in FIG. 5 with the difference that the electric motor 11 is arranged in the stub 13, and that, instead of the electric motor 11, a direction-changing gearbox 18 is arranged in the drive module housing 4. The electric motor is in this case mounted in the stub 13 via a flange 17. The direction-changing gearbox 18 is connected on the one hand to the shaft 5 and on the other hand to an output-drive shaft 22 of the electric motor 11. Therefore, the electric motor 11 drives both propellers 9, 9' via the output-drive shaft 22, the direction-changing gearbox 18, the shaft 5 and the gearbox 8. The shaft 5 and the direction-changing gearbox 18 are borne in the drive module housing 4 via bearings 27. In this case, the shaft 5 is connected to the gearbox shafts 33 such that they rotate together, and the output-drive shaft 22 is connected to the direction-changing gearbox 18 such that they rotate together, via a respective plug connection.

As can be seen from the various refinements of the pod drives shown in FIGS. 5 to 10, the invention provides a modular pod drive which can be assembled cost-effectively from existing standard components, is simple to handle and maintain, and is distinguished by high reliability when using proven and robust technology. The modularity makes it possible to comply flexibly with different requirements for drive power and hydrodynamics. In this case, a pod drive which cannot rotate or a pod drive which can rotate can be produced from the same components. The pod drive may be designed with one or two motors and/or propellers. Furthermore, the drive can be arranged on the floating device such that it can be extended or cannot be extended. In the event of a defect, only the relevant module need be replaced. The pod drive can therefore be repaired quickly and easily.

The invention claimed is:

1. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

a direction-changing gearbox disposed in said drive module housing;

at least one electric motor for driving said shaft;

a stub attached to said underwater housing, said at least one electric motor is disposed in said stub, said electric motor driving said shaft via said direction-changing gearbox;

said shaft being coupled to said gearbox to drive said propeller; and said drive module and said gearbox module forming said underwater housing in its entirety.

2. The pod drive according to claim 1, wherein the pod drive contains one and only one said drive module, and one and only one said gearbox module.

3. The pod drive according to claim 1, further comprising a plug connection, and said shaft is connected via said plug connection to said gearbox.

4. The pod drive according to claim 3, wherein said electric motor has a rotor being coupled to said shaft, a stator and a motor housing, in which said rotor and said stator are disposed.

5. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

said shaft being coupled to said gearbox to drive said propeller;

a hydrodynamically shaped terminating element which, together with said drive module housing and said gearbox module housing, forms said underwater housing; and an electric motor for driving said shaft, said electric motor being an encapsulated motor with water cooling and with a rated rotation speed which is greater than a rated rotation speed of said propeller.

6. The pod drive according to claim 5, wherein said electric motor is disposed in said drive module housing.

7. The pod drive according to claim 6, wherein said gearbox module is used to support said electric motor in a direction of a rotation axis of said shaft.

8. The pod drive according to claim 6, wherein said hydrodynamically shaped terminating element is used to support said electric motor in a direction of a rotation axis of said shaft.

9. The pod drive according to claim 6, wherein said drive module housing is used to support said electric motor in a rotation direction of said shaft.

10. The pod drive according to claim 6, wherein said shaft is born only in said electric motor in said drive module.

11. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

said shaft being coupled to said gearbox to drive said propeller;

a further gearbox module with a gearbox module housing and a gearbox disposed in said underwater housing;

a further propeller; and wherein said further gearbox module being in a form of a separate unit, and said drive module, said gearbox module and said further gearbox modules connected to one another such that said drive module housing and said gearbox module housing form said underwater housing, and said shaft is coupled to said gearbox of said further gearbox module in order to drive said further propeller.

12. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

said shaft being coupled to said gearbox to drive said propeller;

a further drive module having a drive module housing and a shaft disposed in said drive module housing;

a further gearbox module having a gearbox module housing and a gearbox disposed in said gearbox module housing of said further gearbox module;

a further propeller; and wherein said further drive module and said further gearbox module likewise each being in a form of separate units, and with said drive module and said further drive module being connected to one another, and with said further drive module being connected to said further gearbox module, such that said drive module housing and said gearbox module housing form said underwater housing, and said shaft of said further drive module is coupled to said gearbox of said further gearbox module to drive said further propeller.

13. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

said shaft being coupled to said gearbox to drive said propeller;

a further shaft disposed in said drive module housing of said drive module;

a further gearbox module having a gearbox module housing and a gearbox disposed in said gearbox module housing of said further gearbox module;

a further propeller; and wherein said further gearbox module likewise being in a form of a separate unit, and said drive module, said gearbox module and said further gearbox module connected to one another such that said drive module housing and said gearbox module housing form said underwater housing, and said further shaft is coupled to said gearbox of said further gearbox module to drive said further propeller.

14. A pod drive for a floating device, the pod drive comprising:

an underwater housing in a form of a pod and around which water flows;

a drive module having a drive module housing and a shaft disposed in said underwater housing;

a gearbox module having a gearbox module housing and a gearbox disposed in said underwater housing;

a propeller;

said drive module and said gearbox module each being in a form of separate units connected to one another such that said drive module housing and said gearbox module housing form at least a part of said underwater housing;

a stub via which said underwater housing is attached to the floating device;

an electric motor disposed in an interior of the floating device;

a direction-changing gearbox disposed in drive module housing; and a vertical shaft running through said stub, and said shaft provides propulsion via said vertical shaft, and via said direction-changing gearbox.

* * * * *